US005238278A

United States Patent [19]

Kämper

[11] Patent Number: 5,238,278

[45] Date of Patent: Aug. 24, 1993

[54] TEXTILE LIFTING SLING

[75] Inventor: Hans-Werner Kämper, Würselen, Fed. Rep. of Germany

[73] Assignee: Spanset Inter AG, Oetwil Am See, Switzerland

[21] Appl. No.: 829,479

[22] Filed: Feb. 3, 1992

[30] Foreign Application Priority Data

Feb. 7, 1991 [DE] Fed. Rep. of Germany ... 9101387[U]
Oct. 4, 1991 [DE] Fed. Rep. of Germany ... 9112524[U]

[51] Int. Cl.[5] ..... B66C 1/12
[52] U.S. Cl. ..... 294/74; 139/408
[58] Field of Search ..... 294/74–77; 57/210, 234; 139/408–410, 413, 416–419

[56] References Cited

U.S. PATENT DOCUMENTS

| | | | |
|---|---|---|---|
| 2,207,862 | 7/1940 | Henschke | 57/210 X |
| 3,926,227 | 12/1975 | Takada et al. | 139/416 X |
| 4,025,100 | 5/1977 | Bridgehouse . | |
| 4,052,095 | 10/1977 | Johnson | 294/74 |
| 4,116,481 | 9/1978 | Raue . | |
| 4,177,839 | 12/1979 | Kikuchi | 139/419 |
| 4,205,709 | 6/1980 | Duschek . | |
| 4,368,234 | 1/1983 | Palmer et al. . | |
| 4,500,578 | 2/1985 | van de Kamp . | |
| 4,856,837 | 8/1989 | Hammersla, Jr. . | |

FOREIGN PATENT DOCUMENTS

| | | |
|---|---|---|
| 0031785 | 7/1981 | European Pat. Off. . |
| 0116916 | 8/1984 | European Pat. Off. . |
| 0193478 | 9/1986 | European Pat. Off. . |
| 0226971 | 7/1987 | European Pat. Off. . |
| 8620717 | 10/1986 | Fed. Rep. of Germany . |
| 8619730 | 11/1988 | Fed. Rep. of Germany . |
| 3835045 | 4/1990 | Fed. Rep. of Germany . |
| 2336337 | 7/1977 | France . |
| 2355105 | 1/1978 | France . |

OTHER PUBLICATIONS

Deutsche Norm "Hebebänder aus synthetischen Fasern" DIN 61360 Part 1 Mar. 1986.

*Primary Examiner*—David M. Mitchell
*Assistant Examiner*—Dean J. Kramer
*Attorney, Agent, or Firm*—Spencer, Frank & Schneider

[57] ABSTRACT

In a textile lifting sling or in a lashing strap thickened locations are provided at least on one side (7) of the sling in the longitudinal direction (2) of the sling so as project in the manner of longitudinal beads (6) or rows of nubs (9) beyond the outer surface (7) of the basic fabric of the webbing strap (5) or of the tube (4) so as to increase abrasion resistance.

16 Claims, 6 Drawing Sheets

TEXTILE LIFTING SLING

The invention relates to textile lashing straps as well as to textile lifting slings and textile lifting slings configured as endless slings made of a woven webbing strap. Textile lashing straps are employed to lash cargo to be stored and transported. The lashing strap here grips partially around the cargo to be stored or transported and is under tension in its lashed state. The tension can be introduced into the lashing strap, for example, by means of a tensioning ratchet or tensioning winch Lashing straps are employed particularly to tie down or lash down cargo on the load beds of trucks or railroad cars or to lash cargo in transporting containers in such a way that it is secured against sliding around. The textile lifting slings according to the invention serve to lift loads in general, that is, goods of all types. The ends of the lifting slings may be provided with attachment means with which they can be attached to the lifting means or to the load to be lifted. The connection between the lifting means or the load is preferably made releasable while the connection between the lifting sling and the attachment means is preferably non-releasable. Textile lifting slings, however, can also be used directly as attachment means. Such lifting slings which can be employed directly as attachment means are preferably configured as endless slings. The endless sling itself is encased in a woven tubular sheath. The endless sling itself is embedded so to speak in the woven tubular sheath. Preferably the endless sling is connected with the lifting tool by an attachment means. The endless sling is simply placed around the load to be lifted and at least partially girdles the load to be lifted during the lifting process.

Such lifting slings made of synthetic fibers are the subject of DIN [German Industrial Standard] 61,360 (March, 1986, Edition). This standard defines the terminology, dimensions and types of attachments of such a lifting sling in detail so that further comments are not necessary at this point. The transferability of the terms mentioned in this standard to the lashing straps according to the invention is evident.

SUMMARY OF THE INVENTION

In rough everyday use, lashing straps as well as lifting slings are subject to considerable attacks of wear, particularly due to abrasion stresses It is an object of the invention to improve the wear or abrasion resistance of the above-mentioned lashing straps and lifting slings as well as endless slings by simple means which do not adversely affect their utility characteristics. This is accomplished by providing a plurality of thickened fabric locations projecting outward from the exterior surface of a load bearing side of a woven webbing strap and extending in a longitudinal direction of the strap so as to increase the resistance of the strap to abrasion wear.

The basic concept of this solution is to provide intentional abrasion locations that are subjected to wear attacks and keep the wear attacks away from the significant portion of the basic fabric on the outer skin of the lashing strap or lifting sling, namely on the flat surface side that is particularly subjected to wear, and, if necessary, on both flat surface sides. Wear protection is particularly well achieved if several such thickened locations are provided in spaced juxtaposed rows.

Advisably the thickened locations are formed by woven-in textile threads of a wear resistant material.

Tests have shown that only a slight increase in the overall material employed results in a disproportionate improvement of the wear resistance of the lashing straps and lifting slings. The wear resistant textile threads are here woven into the basic fabric of the lifting sling in the direction of the warp or are woven onto it. The wear resistant textile threads may be filament yarns or twines made of synthetic fiber materials or also monofilament textile wires.

The thickened locations which extend in the manner of a longitudinal bead or a longitudinal rib in the longitudinal direction of the sling have the further advantage of increasing the longitudinal stiffness of the lashing strap as well as the lifting sling or endless sling, thus improving their ease of manipulation. Because of this arrangement, the lashing strap and the lifting sling can be pushed through more easily underneath a load. Moreover, the lashing strap can be threaded more easily into the tensioning spindle of a tensioning winch or ratchet. Particularly in connection with lifting slings constructed as endless slings, this increased longitudinal stiffness has the advantage of smoothing the waves formed in the tube around the supporting skein of threads. In endless slings, the tube of necessity has a greater circumferential length in the unloaded state than the skein of threads it surrounds. The waves thus formed by the tube and the resulting danger of it getting caught behind sharp edges of the load are described in detail in the introduction to the specification of EP 0,116,916.B1, where, in order to suppress this wave formation, the transverse rigidity of the protective tube in the form of a tubular fabric is increased by monofilament textile wires as the weft threads.

By configuring the thickened locations as longitudinally oriented ribs or beads, the lifting sling, when not loaded, slides along the cargo due to a greater degree of smoothness that is active in the longitudinal direction of the lifting sling. The longitudinally oriented ribs here act in the manner of sled runners relative to the cargo. When the lashing tension is introduced into the lashing strap, the strap slides better along the goods to be lashed, particularly along its edges. The effectiveness of the introduced lashing tension is enhanced in that the introduced lashing tension is converted directly into lashing force and not into lost friction heat.

Wherever particularly good flexibility in the longitudinal direction is desired for the lifting sling, it may be of advantage to provide a configuration in the form of a row of interrupted nubs instead of continuous, longitudinally oriented ribs or beads, with the increase in wear resistance being substantially ensured at low cost for materials. If fancy or embroidery threads are woven into or onto the fabric in the warp direction, the sled-runner-type action which improves its sliding behavior relative to the cargo remains in effect. This applies as well for the lashing straps according to the invention.

The invention will now be described in greater detail with reference to embodiments thereof that are illustrated in the drawing figures. It is shown in:

Figure 5:
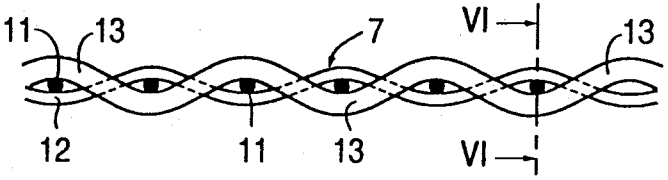
FIG. 5 is a sectional view in the warp direction through the basic fabric along section line V—V of FIG. 6, with the rib or bead formation being created by fancy threads in the basic fabric
Figure 6:
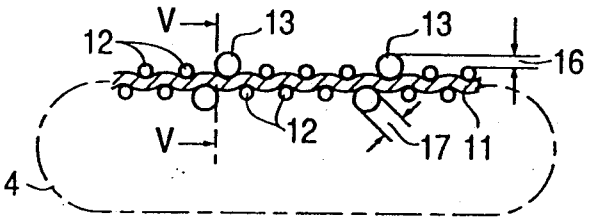
FIG. 6 is a sectional view seen along section line VI—VI of FIG. 5 through the basic fabric of the upper face of the tube of a lifting sling in which ribs or beads are formed by woven-in fancy threads.
Figure 7A:
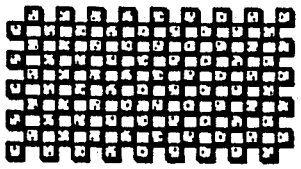

FIG. 7*a* is a top view of the wave pattern of the fabric of FIGS. 5 and 6; and

Figure 8:
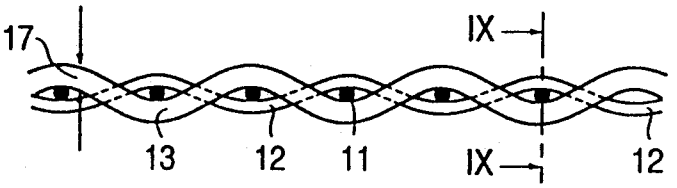
Figure 9:
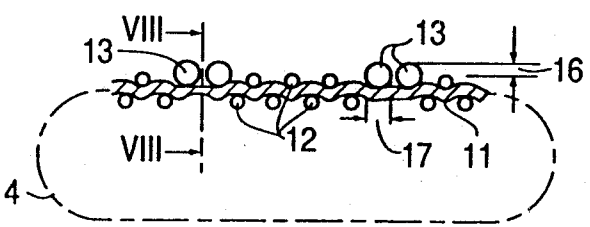
Figure 11A:
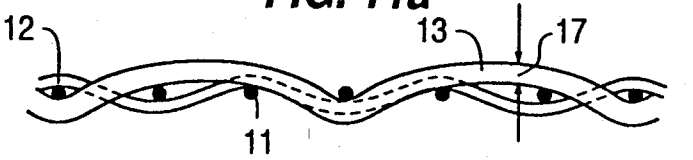
Figure 12:
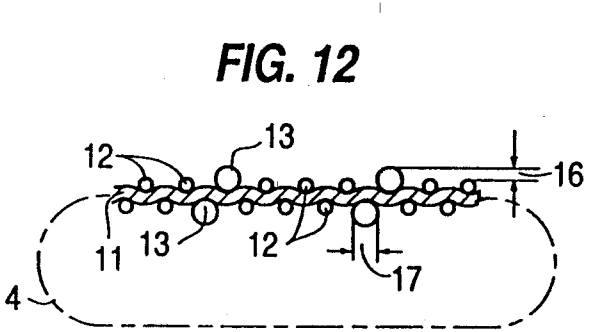
Figure 11B:
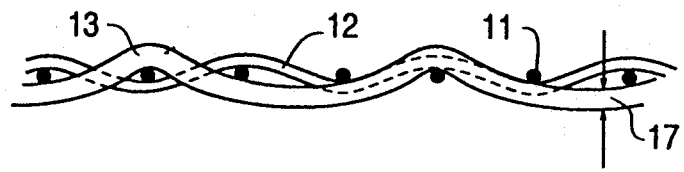
Figure 7B:
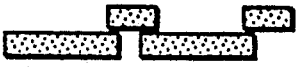
Figure 10A:
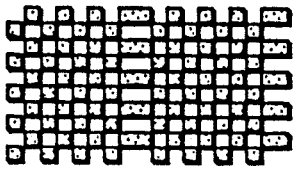
Figure 10B:
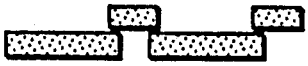
Figure 13A:
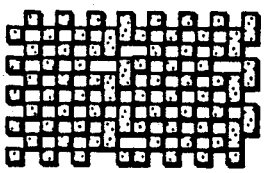
Figure 13B:
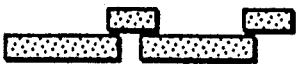
Figure 15:
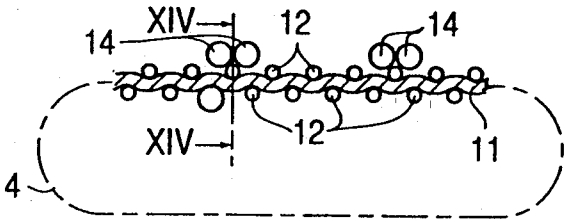
Figure 14A:
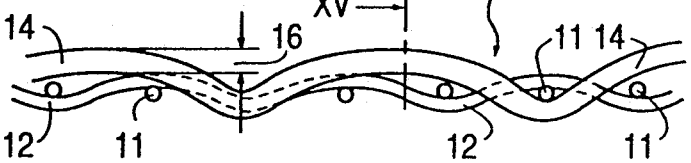
Figure 14B:
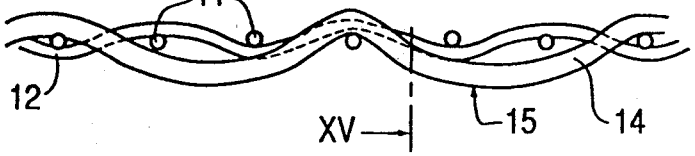

FIG. 7*b* is a side view of the weave pattern of the fabric of FIGS. 5 and 6;

FIG. 8 to FIG. 10*b* are views analogous to FIGS. 5 to 7*b* of a modified form of fabric, respectively, FIG. 11*a* and 11*b* are sectional views in the warp direction analogous to FIGS. 5 and 8, with, however, the fancy threads being woven into the basic fabric in a twill weave;

FIG. 12 is a sectional view seen in the direction of the weft of the fabric of FIGS. 11*a* and 11*b* analogous to the illustrations in FIGS. 6 and 9;

FIG. 13*a* is the associated weave pattern of the fabric of FIGS. 11*a* to 12 in a top view;

FIG. 13*b* is the associated weave pattern of the fabric of FIGS. 11*a* to 12 in a side view;

FIGS. 14*a* and 14*b* are sectional views of the basic fabric seen in the warp direction corresponding to section line XIV—XIV in FIG. 15 in which the ribs or beads are formed by embroidery threads;

FIG. 15 is a sectional view seen along section line XV—XV of FIGS. 14*a* and 14*b;*

Figure 3:
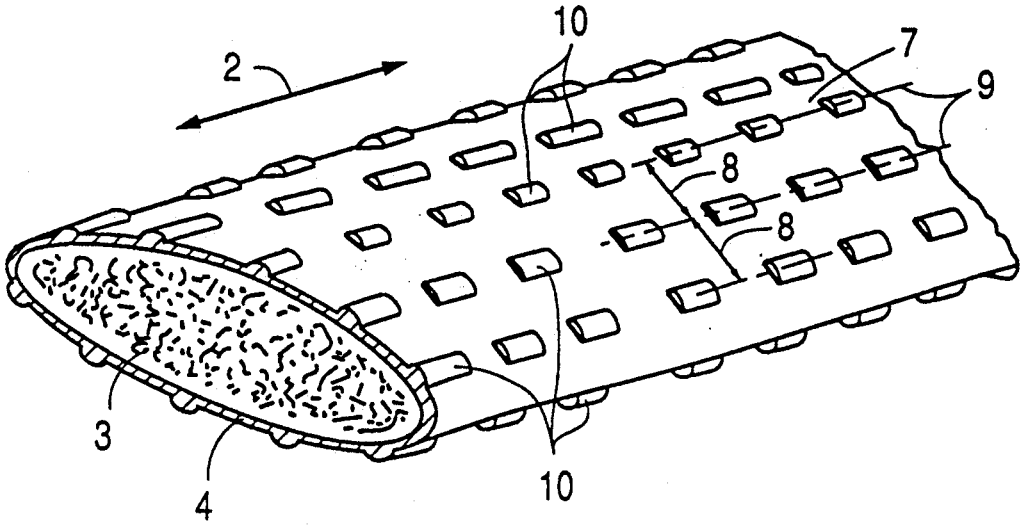
FIG. 3 is a modified embodiment analogous to FIG. 2 in which thickened fabric locations are provided which extend as rows of nubs in the circumferential direction.
Figure 17:
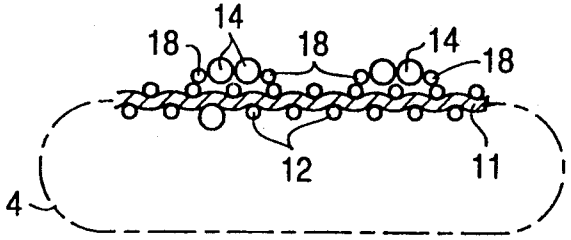
Figure 21:
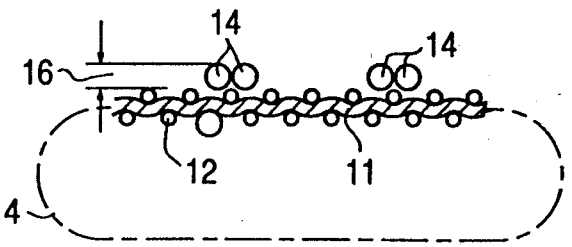
Figure 19:
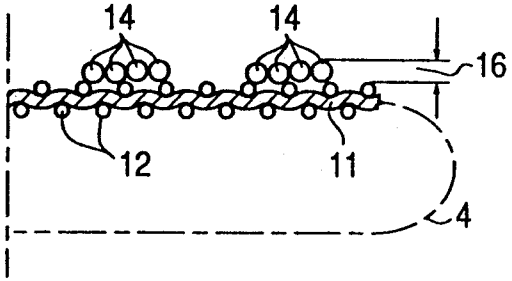
Figure 16A:
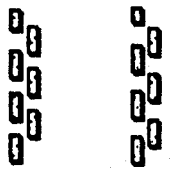
Figure 16B:
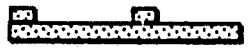
Figure 20A:
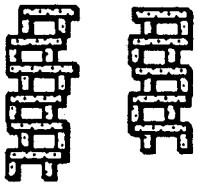
Figure 20B:
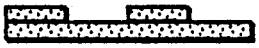
Figure 18A:
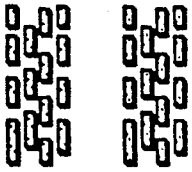
Figure 18B:
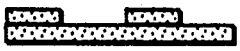
Figure 22A:
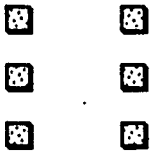
Figure 22B:
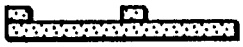

FIGS. 16*a* and 16*b* are a top view, respectively, and a side view of the weave pattern for the fabric according to FIGS. 14*a* to 15;

FIG. 17 is a slight modification of the fabric according to FIGS. 14*a* to 16*b* with ribs and beads, respectively, which in their overall cross section have a semicircular character;

FIG. 18*a* and 18*b* are a top view, respectively, and a side view of the weave pattern belonging to the fabric structure according to FIG. 17;

FIG. 19 is a sectional view, analogous to FIGS. 15 and 17, of the basic fabric seen in the weft direction XX—XV with the embroidery threads being arranged in a modified manner so as to form a very smooth bead in the longitudinal direction;

FIG. 20*a* and 20*b* are a top view, respectively, and a side view of the weave pattern for the fabric of FIG. 19;

FIG. 21 is a sectional view seen in the weft direction XV—XV of FIG. 14 of a modified fabric configuration in which the thickened locations are formed by a row of nubs corresponding to FIG. 3;

FIGS. 22*a* and 22*b* are a top view, respectively, and a side view of the weave pattern belonging to FIG. 21 (tubular fabric!).

DETAILED DESCRIPTION OF THE PREFERRED EMBODIMENTS

Figure 1:
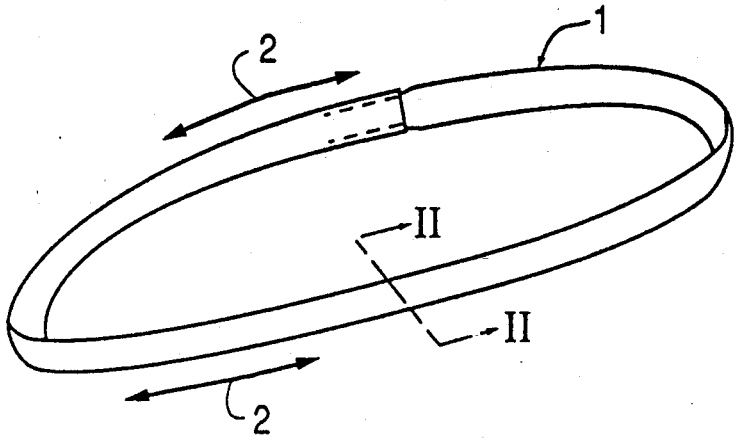
FIG. 1 is a lifting sling in the form of an endless sling.
Figure 2:
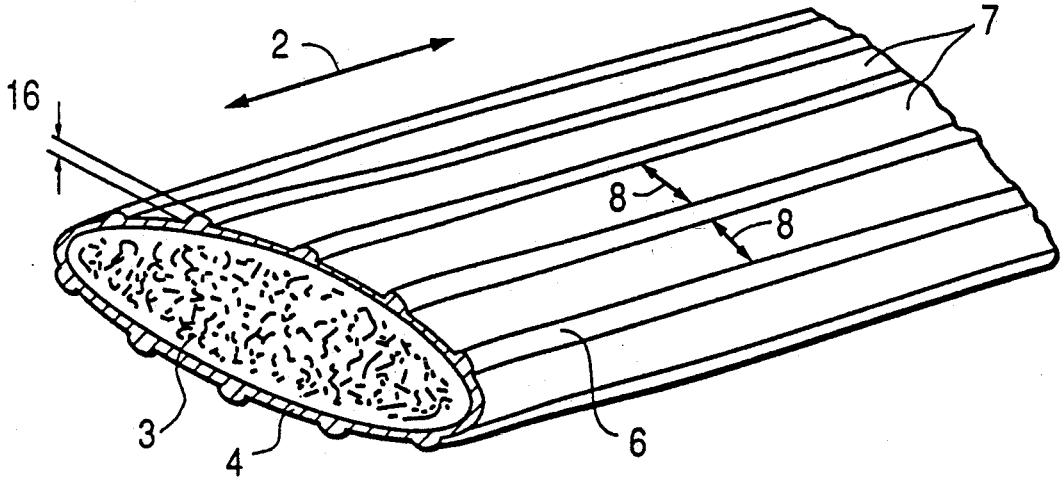
FIG. 2 is an enlarged cross-sectional view seen along section line II—II of FIG. 1 including longitudinal ribs extending in the circumferential direction of the endless sling on an exterior face of a protective tube.

The lifting sling shown in FIGS. 1 to 3 is an endless sling 1 in which a skein of thread 3 is arranged in the circumferential direction 2 for receiving the load and a tube 4 formed of a tubular fabric encloses skein 3. Technically speaking, a tubular fabric is a double layer fabric band in which a bond is provided at the edges of the fabric between the two fabric layers, which is not shown here, however, and which has no particular significance for the core of the invention. In DIN 61360, such endless slings 1 are called "lifting sling, laid".

Figure 4:
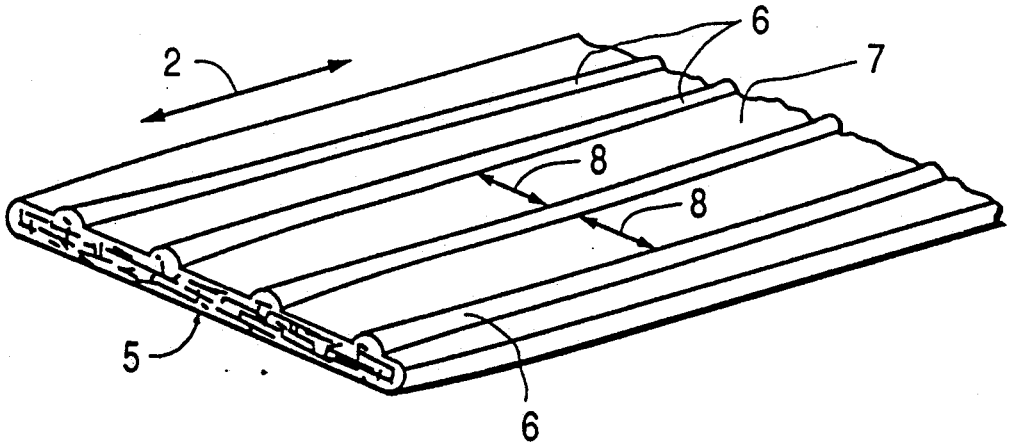
FIG. 4 is a cross-sectional view analogous to FIGS. 2 and 3 through a woven lifting sling or lashing strap.

In contrast thereto, FIG. 4 shows a webbing strap 5 woven of synthetic, multifilament fibers primarily in one layer; however, it may also be configured in multiple layers, particularly two layers, by means of seams or other equivalent connections. Such webbing straps 5 may also be equipped with fittings to fashion a ready-for-use lifting sling of the required carrying strength This webbing strap 5 is likewise well suited for use as a lashing strap.

If the configuration of the surface of a woven lifting sling is generally mentioned, it applies, equally to the weave configuration of the tube 4 (FIGS. 1-3) of an endless sling 1 as well as to the configuration of a webbing strap 5 for lifting slings and lashing straps according to FIG. 4, analogous to the identical treatment of both lifting sling configurations in DIN 61,360 and their evident suitability as lashing straps The lifting slings and lashing straps, according to FIGS. 2 and 4 to 20 are provided with thickened locations in the form of ribs or beads 6 that are, raised from the remaining exterior surface 7 to project outwardly and extend in the longitudinal and circumferential direction 2, respectively, on at least one surface. Such ribs or beads 6 are disposed next to one another at substantially regular intervals 8 on at least one surface side. In the lifting sling according to FIG. 3, however, rows of nubs 10 oriented in the longitudinal direction 2 project outward instead as thickened locations from the outer surface 7 of the lifting sling.

Ribs 6 and nubs 10 projecting as thickened locations are formed by textile yarns or wires that are worked into the fabric of the lifting slings. These may be filament yarns, twines, or monofilament textile wires of the same or another material than the yarn of the basic fabric. To form the basic fabric, textile threads can be employed in all known basic weave patterns, such as linen weave, twill weave and satin weave. In the drawing figures, the basic fabric is usually shown as a linen weave. In these figures, particularly in the sectional views of FIGS. 6, 9, 12, 15, 17, 19 and 21 which are oriented in the weft direction, only two ribs 6, bead forming threads or nubs 10 (FIGS. 21, 22) are shown in each case. However, the number of ribs 6 arranged at substantially identical distances 8 from one another or the number of rows of nubs 9, can be selected as desired according to the particular requirements and the width of the tube or strap.

The individual fabric illustrations in the mentioned FIGS. 6, 9, 12, 15, 17, 19 and 21 each show the tube fabric 4 of an endless sling 1. However, they apply analogously for the weave of a webbing strap 5 that can be further processed into lifting slings or lashing straps.

In principle, these examples show two methods of weaves to be produced, namely the forming of ribs or nubs by fancy threads in the basic fabric (FIGS. 5 to 13) or by embroidery threads on the basic fabric (FIGS. 14-22).

In FIGS. 5 to 22, the weft threads of the basic fabric are marked 11 and the warp threads of the basic fabric are marked 12. The ribs 6 are produced by means of fancy threads 13 incorporated into the basic fabric. In this case, one or several juxtaposed warp threads 12 of the basic fabric, that is foundation threads, are exchanged for fancy threads 13. The different characteristics of the fancy threads 13 compared to the foundation or warp threads 12 in the present case are primarily due to the greater thickness of the fancy so that in the fabric the fancy threads project outwardly like beads from the foundation weave formed by weft threads 11 and warp threads 12 of the basic fabric. FIGS. 5 and 6 show in a linen weave the replacement of pairs of adjacent foundation threads, here warp threads 12, by thicker fancy threads 13 per bead 6.

FIG. 9 is an example for the formation of nubs 10 in tube 4. The nub formation may be realized by single, double or multiple passes or by means of longitudinal or transverse grosgrain weaves. In any case, two juxtaposed fancy threads 13 pass weft threads 11 on the same side in this embodiment. FIGS. 11 to 13 show a slight modification compared to the fabric structure of FIGS. 5 and 6; in the weave technology employed here the fancy threads 13 are woven in a twill weave. The twill weave results in a better smoothness of rib 6 in longitudinal direction 2.

The embroidery threads employed in the fabric structure of FIGS. 14 to 22 are marked 14. FIGS. 14 to 16 show a simple example of the use of embroidery threads 11 on the basic fabric (warp threads 12 and weft threads 11) in a twill weave. Here embroidery threads 14 in each case skip two juxtaposed weft threads 11 on the outer surface 7 of the fabric before they pass the next weft thread 11 on the inner surface of the fabric. The two embroidery threads 14 that extend next to one another in order to form a rib 6 are here not necessarily woven into the weft threads 11 in the same manner. Rather they are guided in such a manner that the one embroidery thread 14 bridges two juxtaposed weft threads 11 on the outer surface 7 (FIG. 14*a*) while the other, adjacent embroidery thread 14 bridges two juxtaposed weft threads 11 on the interior face 15 before it passes the next weft thread on the other side of the fabric.

However, in the type of weave shown in FIG. 17, thinner embroidery threads 16 are provided in addition to the two outer embroidery threads 14 that form a bead and these additional threads are guided in such a manner that the beads 6 as a whole have a semi-circular cross-sectional character.

FIGS. 19 and 20 show a grosgrain weave with rearrangement of the threads for the purpose of avoiding contact between the not necessarily regular interlacing of the embroidery threads so that a very smooth bead 6 results in the longitudinal direction 2.

FIGS. 21 and 22 show the formation of nubs 10 by embroidery threads 14.

The degree to which ribs 6 and nubs 10 project beyond the outer surface 7 of the lifting sling or lashing strap is marked 16. The projection height for ribs 6 or nubs 10 beyond the outer surface of the lifting sling or lashing strap is at least 20% of the thickness of the basic fabric.

The thread thickness 17, namely the diameter of fancy threads 13, is advisably at least twice as great as the thread thickness or the diameter, respectively, of warp threads 11 and weft threads 12, respectively.

I claim:

1. In a woven webbing strap suitable for lifting loads and having a basic fabric exterior surface of longitudinal warp threads and lateral weft threads, and having at least two sides, the improvement comprising:

a plurality of thickened fabric locations projecting outwardly from the exterior surface of at least one side of the strap and extending in a longitudinal direction of the strap so as to form at least one of a longitudinal rib and a longitudinal row of nubs to increase the resistance of the strap to abrasion, said thickened fabric locations being arranged in juxtaposed rows with substantially identical spacing therebetween and arranged such that, in a cross-sectional view of the strap, the rows of thickened fabric locations have semi-circular cross-sectional projections from the surface of said basic fabric, said rows comprising embroidery threads having different thread thicknesses.

2. A woven webbing strap as recited in claim 1, wherein said thickened fabric locations further comprise woven-in textile threads of a wear resistant thread.

3. A woven webbing strap as recited in claim 2, wherein said textile threads are woven into the exterior surface of said strap in the direction of the warp threads.

4. A woven webbing strap as recited in claim 2, wherein said textile threads are filament yarns or twines comprising one of synthetic fibers and monofilament textile wires.

5. A woven webbing strap as recited in claim 1, wherein the rows of said thickened fabric locations extend over the entire length of the strap.

6. A woven webbing strap as recited in claim 1, wherein the rows of said thickened fabric locations extend over the entire width of a least one side of the strap.

7. In a woven webbing strap suitable for lifting loads and having a basic fabric exterior surface of longitudinal warp threads and lateral weft threads, and having at least two sides, the improvement comprising:

a plurality of thickened fabric locations projecting outwardly from the exterior surface of at least one side strap so as to form at least one of a longitudinal rib and a longitudinal row of nubs to increase the resistance of the strap to abrasion, wherein each of said thickened fabric locations comprises at least two juxtaposed fancy threads having the same thickness in said basic fabric.

8. A woven webbing strap as recited in claim 7, wherein at least one of said fancy threads have a thickness greater than a thickness of a weft thread or a warp thread of said basic fabric.

9. A woven webbing strap as recited in claim 8, wherein said fancy thread thickness is at least twice as greater as the thickness of the weft thread or the warp thread of said basic fabric.

10. A woven webbing strap as recited in claim 7, wherein said fancy threads have a projection height above the exterior surface of the basic fabric of at least 20% of the thickness of the basic fabric.

11. A woven webbing strap as recited in claim 7, wherein the rows of said thickened fabric locations extend over the entire length of the strap.

12. A woven webbing strap as recited in claim 7, wherein the rows of said thickened fabric locations extend over the entire width of a least one side of the strap.

13. In a woven webbing strap suitable for lifting loads and having a basic fabric exterior surface of longitudinal warp threads and lateral weft threads, and having at least two sides, the improvement comprising:

a plurality of thickened fabric locations projecting outwardly from the exterior surface of at least one side of the strap and extending in a longitudinal direction of the strap so as to form at least one of a longitudinal rib and a longitudinal row of nubs to increase the resistance of the strap to abrasion, wherein each of said thickened locations comprises at least two juxtaposed embroidery threads having the same thickness on said basic fabric.

14. A woven webbing strap as recited in claim 13, wherein said embroidery threads have a projection height above the exterior surface of the basic fabric of at least 20% of the thickness of the basic fabric.

15. A woven webbing strap as recited in claim 13, wherein the rows of said thickened fabric locations extend over the entire length of the strap.

16. A woven webbing strap as recited in claim 13, wherein the rows of said thickened fabric locations extend over the entire width of a least one side of the strap.

* * * * *